US011701704B1

(12) United States Patent
Wang et al.

(10) Patent No.: US 11,701,704 B1
(45) Date of Patent: Jul. 18, 2023

(54) PROCESSING DIE AND PREPARATION METHOD FOR FASTENER

(71) Applicant: XUZHOU UNIVERSITY OF TECHNOLOGY, Xuzhou (CN)

(72) Inventors: Xiaoxi Wang, Xuzhou (CN); Xiang Zhang, Xuzhou (CN); Junchi Yuan, Xuzhou (CN); Zhiwei Yin, Xuzhou (CN); Tingyu Liang, Xuzhou (CN)

(73) Assignee: XUZHOU UNIVERSITY OF TECHNOLOGY, Xuzhou (CN)

( * ) Notice: Subject to any disclaimer, the term of this patent is extended or adjusted under 35 U.S.C. 154(b) by 0 days.

(21) Appl. No.: 17/568,800

(22) Filed: Jan. 5, 2022

(51) Int. Cl.

| | |
|---|---|
| ***B21H 3/02*** | (2006.01) |
| ***B21D 37/10*** | (2006.01) |
| ***B21C 25/02*** | (2006.01) |
| *B21C 23/00* | (2006.01) |

(52) U.S. Cl.
CPC ..... *B21H 3/02* (2013.01); *B21C 25/02* (2013.01); *B21D 37/10* (2013.01); *B21C 23/001* (2013.01)

(58) Field of Classification Search
CPC ..... B21C 23/001; B21C 23/005; B21C 23/08; B21C 23/147; B21C 23/183; B21C 25/02; B21H 3/02; B21K 1/56
See application file for complete search history.

(56) References Cited

U.S. PATENT DOCUMENTS 4,300,378 A * 11/1981 Thiruvarudchelvan ..... B21C 25/02 72/274
4,598,567 A * 7/1986 Backus ..... B21C 25/025 72/262
5,167,138 A * 12/1992 Sinha ..... B21C 23/005 72/262

OTHER PUBLICATIONS

CN 106111718A, Yu et al. Nov. 2016.*
JP 7-148544A, Ando et al. Jun. 1995.*
CN 109097733A, Zhang et al. Jun. 2018.*
Translation CN 109097733A, Zhang et al. Jun. 2018.*
CN 108714631A, Cai et al. Oct. 2018.*
JP 2005-991A, Mizunuma Jan. 2005.*
EP 2705912A1, Krystian et al. Mar. 2014.*

* cited by examiner

*Primary Examiner* — Edward T Tolan
(74) *Attorney, Agent, or Firm* — Hoffmann and Baron, LLP; Anthony Bennett

(57) ABSTRACT

A processing die and a preparation method for a fastener are provided. The processing die includes a punch and a die. The top of the punch and the bottom of the die are configured for being connected with a hydraulic press, the die includes a first half die and a second half die which are clamped to form an inlet channel, an expansion corner channel and a torsion channel, and an extrusion channel is included in the forming sliding block, the inlet channel, the expansion corner channel, the torsion channel and the extrusion channel are sequentially assembled to form a die channel cavity, and a (Continued)

billet to be processed is successively subjected to upsetting, shearing, torsion and extrusion in a single die under the pressure of the punch.

16 Claims, 4 Drawing Sheets

PROCESSING DIE AND PREPARATION METHOD FOR FASTENER

TECHNICAL FIELD

The present disclosure relates generally to the technical field of metal plastic forming, and more particularly relates to a processing die and a preparation method for a fastener.

BACKGROUND

With the rapid development of the aerospace technology in China and the increasing requirements for the aircraft reliability, materials with high performance are developed for the fastener. Due to titanium alloy having the advantages, such as high specific strength, good corrosion resistance, excellent fatigue properties, high temperature resistance, no magnetism and good compatibility with composite materials, it becomes a preferred material for manufacturing advanced aviation fasteners. At present, more and more titanium alloy fasteners are gradually replacing traditional alloy steel fasteners so as to meet the urgent demands for high performance and weight reduction of spacecraft. Titanium alloy bolts are ones of aviation fasteners most commonly used, most titanium alloys are prone to cracks and other defects during cold heading due to poor deformability, thus high-temperature titanium alloys are mainly used for hot upsetting forming for production. However, the upsetting process is quite complicated and comprises the deformations of extrusion, upsetting, straightening, punching and the like, and the product quality is influenced by many factors such as the part structure, dimensional accuracy, materials, equipment and dies. Meanwhile, when the billet is heated, it is most likely that some serious defects, such as surface oxidation, local burning loss, and overheating, may be generated. Therefore, it is difficult to achieve automatic continuous upsetting and has some disadvantages, such as high labor intensity, poor product quality and low production efficiency.

Therefore, a problem urgently needed to be solved in the current industry is how to break through the bottleneck of the existing forming technology, develop an advanced process, produce high-performance titanium alloy bolt fasteners with a high-quality, high-efficiency and stable production, and meet the performance requirements of various types of the aircraft.

SUMMARY

The present disclosure aims to provide a processing die and a preparation method for a fastener so as to solve problems in the prior art. The strength and toughness of the fastener can be remarkably improved while the shape requirement of the fastener is met, and then the shape and property integration design of a high-performance fastener is achieved.

In order to achieve the purpose, the present disclosure provides the following scheme:

The present disclosure provides a processing die and a preparation method for a fastener. The processing die includes a punch and a die which are assembled, the top of punch and the bottom of the die are configured for being assembled to a hydraulic press, the die includes a first half die and a second half die which are clamped to form an inlet channel, an expansion corner channel and a torsion channel, a forming sliding block is included in the die, an extrusion channel is included in the forming sliding block, a shape of the extrusion channel is configured to match with that of the fastener, the inlet channel, the expansion corner channel, the torsion channel and the extrusion channel are sequentially assembled to form a die channel cavity, and a billet to be processed is successively subjected to upsetting in the inlet channel, shearing in the expansion corner channel, torsion in the torsion channel and extrusion in the extrusion channel under the pressure of a punch.

The present disclosure also provides a method for preparing a fastener by using a processing die, which includes the following steps:

manufacturing the processing die of a fastener to be processed according to the geometry of the die channel;

assembling the processing die, installing the die on a workbench of the hydraulic press, and installing the punch on an upper sliding block of the hydraulic press;

preheating the processing die, and heating the billet to be processed and performing heat preservation treatment, according to the processing requirements;

placing the billet to be processed into the inlet channel, starting the hydraulic press, moving the punch downwards to a predetermined height, then returning the hydraulic press;

removing the forming sliding block from the die;

removing the processed fastener from the forming sliding block;

replacing a new forming sliding block;

repeating a process from placing the billet to replacing the forming sliding block.

Compared with the prior art, the present disclosure has the following technical effects:

An upsetting-torsion-extrusion compound severe plastic deformation technique is introduced in the preparation process of a fastener, and asymmetric shearing stress, large gradient strain and high hydrostatic pressure are generated by taking advantages of continuous transition changes of the cross-sectional shape and dimension of the die channel cavity and torsional shearing, which facilitate for obtaining ultrafine grained (UFG) materials with gradient microstructure under the condition of relatively lower deformation temperature, improving the formability of the material at low temperature, generating a gradient distribution of grain size from surface to core, and thereby improving the microstructure refinement effect and the comprehensive performance of the material, so that the material has high strength and good plasticity and toughness, and the abrasion resistance and fatigue resistance of the fastener are remarkably improved. Accordingly, the high-strength and high-toughness fastener which is of the ultrafine grained microstructure with gradient size distribution and has the shape and the dimension meeting the requirements of application could be processed, thus providing a novel idea for controlling over both the shape and the performance of a high-performance aviation fastener.

Figure 1:
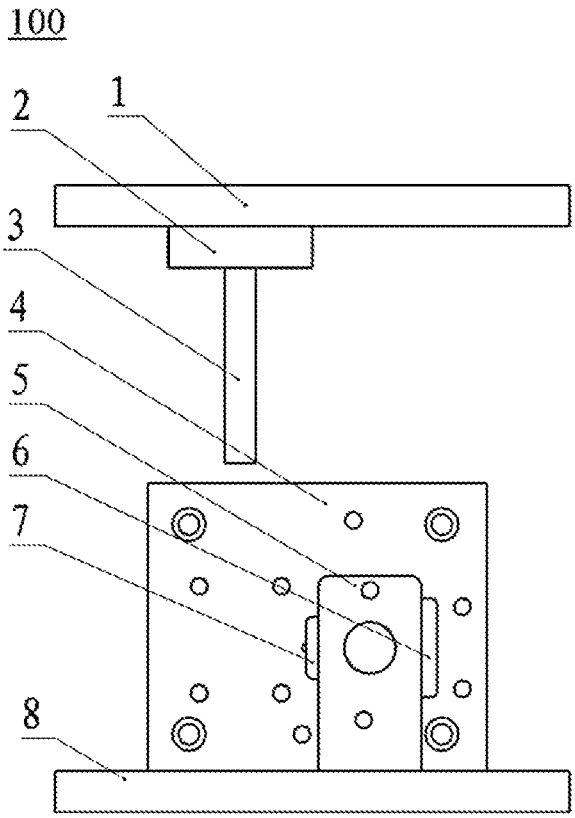
FIG. 1 is a front view of a processing die of a fastener in the present disclosure.

Reference numerals: 100 processing die for a fastener; 1 upper die plate; 2 punch fixed plate; 3 punch; 4 die; 5 limiting side plate; 6 sliding block baffle; 7 forming sliding block; 8 lower die plate; 41 first half die; 42 second half die; 43 loaded bolt; 44 fixed bolt; 45 side plate bolt; 46 dowel pin; 47 heating rod hole; 421 sliding block hole; 422 inlet channel; 423 expansion corner channel; 424 torsion channel; 425 air leakage hole; and 51 extrusion channel.

DETAILED DESCRIPTION OF PREFERRED EMBODIMENTS

The present disclosure aims to provide a processing die and a preparation method for a fastener so as to solve problems in the prior art, the strength and toughness of the fastener can be remarkably improved while the shape requirement of the fastener is met, and then the shape-property integrated design of a high-performance fastener is achieved.

To make the foregoing objective, features and advantages of the present disclosure clearer and more comprehensible, the present disclosure is further described in detail below with reference to the accompanying drawings and specific embodiments.

Embodiment I

Figure 2:
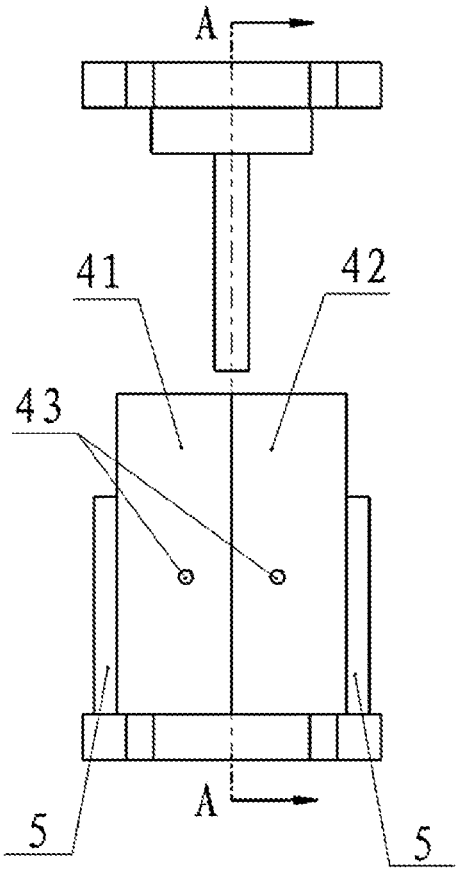
FIG. 2 is a side view of a processing die of a fastener in the present disclosure.
Figure 3:
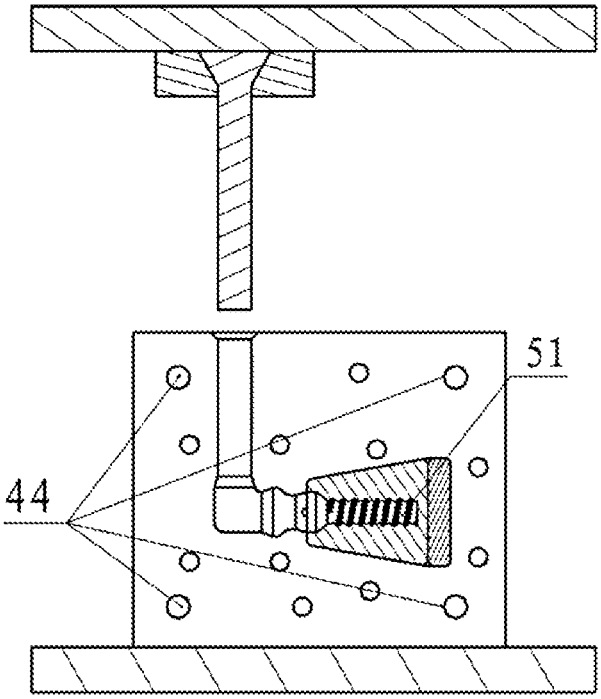
FIG. 3 is a section view along line A-A of FIG. 2.
Figure 4:
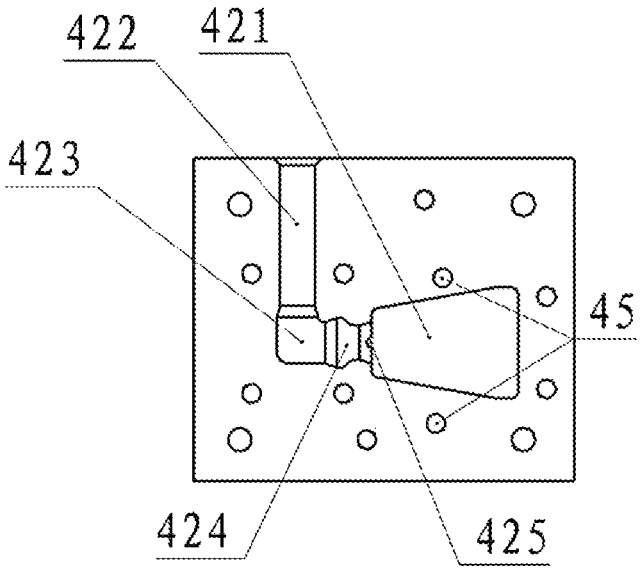
FIG. 4 is a schematic diagram of a first half die in the present disclosure.
Figure 5:
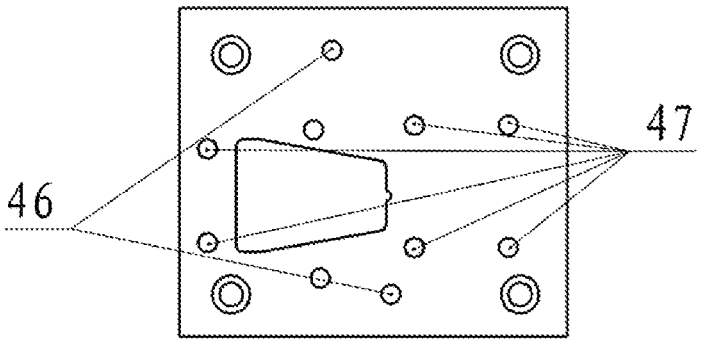
FIG. 5 is a schematic diagram of a second half die in the present disclosure.

As shown in FIG. 1 to FIG. 5, the embodiment provides a processing die 100 of a fastener. The processing die 100 includes a punch 3 and a die 4 which are assembled, the top of the punch 3 and the bottom of the die 4 are configured for being connected with a hydraulic press. The die 4 includes a first half die 41 and a second half die 42, the first half die 41 and the second half die 42 are clamped to form an inlet channel 422, an expansion corner channel 423 and a torsion channel 424. A forming sliding block 7 is included in the die 4, an extrusion channel 51 is included in the forming sliding block 7, and a shape of the extrusion channel 51 is configured to match with that of the fastener. The inlet channel 422, the expansion corner channel 423, the torsion channel 424 and the extrusion channel 51 are sequentially assembled to form a die channel cavity and a billet to be processed is successively subjected to upsetting in the inlet channel 422, shearing in the expansion corner channel 423, torsion in the torsion channel 424 and extrusion in the extrusion channel 51 under the pressure of a punch 3. A compound severe plastic deformation method including upsetting-torsion-extrusion is introduced in the preparation process of the fastener, and asymmetric shearing stress, large gradient strain and high hydrostatic pressure are generated by taking the advantages of continuous transition changes of the cross-sectional shape and dimension of the die channel cavity and torsional shearing, which facilitate for obtaining ultrafine grained materials with gradient microstructure under the condition of relatively lower deformation temperature, improving the low-temperature formability of the material under low temperature, generating a gradient distribution of grain size from surface to core and thereby improving the microstructure refinement effect and the comprehensive performance of the material, so that the material has high strength and good plasticity and toughness at the same time, and the abrasion resistance and fatigue resistance of fastener are remarkably improved. Accordingly, the high-strength and high-toughness fastener which is of the ultrafine grained microstructure with gradient size distribution and has the shape and the dimension meeting the requirements of application could be prepared, providing a novel idea for controlling over both the shape and the performance of a high-performance aviation fastener.

In the embodiment, an upper die plate 1 is installed at the top of punch 3 and configured for being assembled to an upper sliding block of the hydraulic press, and a lower die plate 8 is installed at the bottom of the die 4 and configured for being assembled to a workbench of the hydraulic press. The first half die 41 and the second half die 42 can be disassembled via dowel pins 46 and fixed bolts 44.

In the embodiment, multiple heating rod holes 47 are provided in the die 4, the heating rod holes 47 are configured for placing heating rods, and the heating rod holes 47 are located on outer sides of the inlet channel 422, the expansion corner channel 423, the torsion channel 424 and the extrusion channel 51.

In the embodiment, the inlet channel 422 is placed vertically, the top of the inlet channel 422 is a billet entrance, the bottom of the inlet channel 422 connects with the expansion corner channel 423, a cross section of the inlet channel 422 is circular, and a length of the inlet channel 422 is the same as the displacement of punch 3 in the forming process the fastener.

In the embodiment, the expansion corner channel 423 includes a vertical channel and a horizontal channel, the top of the vertical channel connects with the bottom of the inlet channel 422, the bottom of the vertical channel connects with one side of the horizontal channel through an equal-channel intersection of 90°, and the other side of the horizontal channel connects with the torsion channel 424. A cross section of the vertical channel is circular, a cross-sectional dimension of the vertical channel is gradually increased from the top to the bottom, a cross-sectional dimension of the top of the vertical channel is the same as that of the inlet channel 422, and a cross-sectional dimension of the bottom of the vertical channel is the same as that of the horizontal channel.

In the embodiment, one side of the torsion channel 424 connects with the other side of the horizontal channel, the other side of the torsion channel 424 connects with one side of the extrusion channel 51, and the cross-sectional shape of the both ends of the torsion channel 424 are circular. A cross-sectional dimension of the one side of the torsion channel 424 is the same as that of the other side of the horizontal channel, a cross-sectional dimension of the other side of the torsion channel 424 is the same as that of the one side of the extrusion channel 51, and the cross-sectional area of each section of the torsion channel 424 is the same. A cross section of the torsion channel 424 is in shape changed from a circle to an initial ellipse, gradually changed from the initial ellipse to a final ellipse and changed from the final ellipse to a circle from one side to the other side of the torsion channel 424 continuously, and the cross-sectional dimension of the circle after transition is the same as that of the horizontal channel. The section of the final ellipse is twisted by 90° relative to the section of the initial ellipse, so that a long axis of the initial ellipse is perpendicular to that of the final ellipse, and the dimensions of long axes and short axes of the initial ellipse and the final ellipse and the ratio between long and short axes of the initial ellipse and the final ellipse can be changed according to the technological requirements.

In the embodiment, the extrusion channel 51 includes a head channel and a threaded screw channel, one side of the head channel connects with the other end of the torsion channel 424, the cross-sectional dimension of the one side of the head channel is the same as that of the other side of the torsion channel 424, the other side of the head channel connects with the threaded screw channel, a cross section of the head channel is circular, and a cross-sectional dimension of the head channel is gradually decreased from the one side of to the other side.

In the embodiment, the sum of volumes of the inlet channel 422, the expansion corner channel 423, and the torsion channel 424 is the same as a volume of the billet to be processed, and a volume of the extrusion channel 51 is the same as that of the billet to be processed.

In the embodiment, the first half die 41 and the second half die 42 contain a sliding block hole 421 respectively, the sliding block hole 421 is wedge-shaped, the forming sliding block 7 and a sliding block baffle 6 are installed into the sliding block hole 421, and the sliding block baffle 6 is assembled to the forming sliding block 7; an air leakage hole 425 is set in the sliding block hole 421 and communicates with the atmosphere. The forming sliding block 7 and the sliding block baffle 6 are detachably connected with the first half die 41 or the second half die 42 via loaded bolts 43 respectively. Limiting side plates 5 are respectively installed on the two sides of the forming sliding block 7 and the sliding block baffle 6, which are detachably connected with the first half die 41 or the second half die 42 via side plate bolts 45. Axes of the loaded bolt 43 are perpendicular to axes of the side plate bolt 45.

In the embodiment, the forming sliding block 7 may be of a wedge integrated or a split type design. When the split type design is used, the forming sliding block 7 includes two half sliding blocks, the two half sliding blocks are clamped to form the extrusion channel 51, the two half sliding blocks are respectively installed in sliding block holes 421 of the first half die 41 and the second half die 42, and the half sliding block and the sliding block baffle 6 installed in the same sliding block hole 421 are detachably connected with the first half die 41 or the second half die 42 via the loaded bolts 43. The limiting side plates 5 are installed on the outer sides of the half sliding block and the sliding block baffle 6 on the same side.

In the embodiment, the forming sliding block 7 is used associated with the sliding block baffle 6, and limiting side plates are used associated with the loaded bolts 43. In the assembling process, the forming sliding block 7 is installed into the sliding block hole 421 which is wedge-shaped to limit the degree of freedom in the height direction. The limiting side plates limit the longitudinal degree of freedom to ensure that the extrusion channel 51 is in positioning connection with the torsion channel 424. The sliding block baffle 6 and the loaded bolts 43 limit the horizontal degree of freedom of the forming sliding block 7. The quick disassembling method includes the following steps: removing the sliding block baffle 6 to cancel the longitudinal degree of freedom; removing the loaded bolts 43 and the sliding block baffle 6 to cancel the horizontal degree of freedom; and removing the forming sliding block 7 both in the horizontal wedge direction and in the longitudinal direction. Several groups of forming sliding blocks 7 can be prepared and replaced alternately for use, so that rapid and continuous production of fasteners could be achieved.

The design of the replaceable forming sliding block 7 and being matched with the die 4 has many advantages, such as excellent formability and high production efficiency. On the one hand, high-precision forming of the shape of the fastener is guaranteed, on the other hand, the forming sliding block 7 can be rapidly replaced to achieve continuous production, thus the processing die is suitable for high-efficiency, high-quality and continuous production of fasteners made of hard-deformed materials.

Embodiment II

The embodiment also provides a method for preparing a fastener by using the processing die 100 of a fastener in the first embodiment. The embodiment uses a homogenized round rod TC4 (Ti-6Al-4V) titanium alloy ingot as a billet to be processed, and the fastener is a bolt. The embodiment is also suitable for a method for manufacturing other fasteners made of hard-deformed light metal materials. The method includes the following steps of:

Step one, the processing die 100 of a fastener is manufactured according to the geometry of the die channel;

Step two, the processing die 100 of a fastener is assembled, specifically, the first half die 41 and the second half die 42 are assembled via fixed bolts 44 and dowel pins 46 and fixed on a lower die plate 8, the inner surfaces of sliding block holes 421 are coated with a high-temperature release agent, a forming sliding block 7 and a sliding block baffle 6 are assembled into the sliding block holes 421 and limited via limiting side plates 5 and loaded bolts 43, the die 4 is installed on a workbench of a hydraulic press via the lower die plate 8, the punch 3 is installed in the punch fixed plate 2 and fixed on the upper die plate 1, and the punch 3 is installed on an upper sliding block of the hydraulic press via the upper die plate 1;

Step three, according to the technical requirements, the processing die 100 of a fastener is preheated at the temperature of 320° C., the billet to be processed is heated and performed heat preservation until a preheating temperature of the billet to be processed is 350° C., the billet to be processed is taken from an electric furnace, the outer surface of the billet to be processed is coated with a high-temperature lubricating agent, and the billet to be processed is quickly put into the inlet channel 422;

Step four, the billet to be processed is inserted into the inlet channel 422, the outer surface of punch 3 is coated with the high-temperature lubricating agent, the hydraulic press is started, punch 3 goes downwards to the predetermined height and stops, then the hydraulic press returns and punch 3 is raised;

according to the embodiment, the billet is extruded from the die by "billet to billet", according to the forming principle that the two billets to be processed extrude a fastener and an equal-volume conversion relation between the channel cavity and a single billet to be processed, the entrance of the expansion channel is determined to be as the maximum height position of punch 3 in the process of bolt forming;

according to the constant volume law (i.e., the volume of metal is kept unchanged in the plastic deformation process), the volume V of the channel cavity could be calculated, supposing the cross-sectional area of the billet to be processed is S, thus the height of the billet to be processed can be calculated by the formula of $H=V/S$;

Step five, unscrewing the loaded bolts 43, the limiting side plates 5 are removed, the sliding block baffle 6 are removed, and the forming sliding block 7 in the die 4 are removed;

Step six, a processed fastener is removed from the forming sliding block 7, and a cavity of the forming sliding block 7 is cleaned for the next application;

Step seven, a replaceable forming sliding block 7 is installed, the sliding block baffle 6 is installed, the limiting side plates 5 are installed, and the loaded bolts 43 are tightened;

Step eight, repeating the above steps from placing the billet (step four) to replacing the forming sliding block (step seven) to achieve continuous and high-quality production.

Through introducing a compound severe plastic deformation method including upsetting-torsion-extrusion, high hydrostatic pressure and large shear strain can be generated in the material, which improves the formability of the material under lower temperature, increases the strength and toughness of the material and the forming efficiency of the fastener, and achieves the shape-property integrated forming of the fastener.

According to the embodiment, the billet to be processed is successively subjected to various different deformation forms such as upsetting, shearing, torsion and extrusion in a single pass of extrusion, asymmetric shearing stress, large gradient strain and high hydrostatic pressure can be generated in the material by taking advantages of the continuous transition changes of the cross-sectional shape and dimension of the die channel and the torsional shearing, which facilitate to generate a gradient distribution of grain size of the material changing from surface to core, and thereby improving the microstructure refinement effect and the comprehensive performance of the material, so that the high-strength and high-toughness fastener which is of the ultra-fine grained microstructure with gradient size distribution and has the shape and dimension meeting the requirements of application is processed.

What is claimed is:

1. A processing die for a fastener, comprising:

a punch and a die which are assembled, wherein a top of the punch and a bottom of the die are configured for being installed on a hydraulic press, and wherein the die comprises:

a first half die and a second half die which are clamped to form an inlet channel, an expansion corner channel and a torsion channel; and a forming sliding block including an extrusion channel, a shape of the extrusion channel being configured to match with that of the fastener;

wherein the inlet channel, the expansion corner channel, the torsion channel and the extrusion channel are sequentially assembled to form a die channel cavity, and a billet to be processed is successively subjected to upsetting in the inlet channel, shearing in the expansion corner channel, torsion in the torsion channel and extrusion in the extrusion channel under a pressure of the punch; and wherein the first half die and the second half die contain a sliding block hole respectively, the sliding block hole is wedge-shaped, the forming sliding block and a sliding block baffle are installed into the sliding block hole, and the sliding block baffle is assembled to the forming sliding block;

an air leakage hole is formed in the sliding block hole and communicates with atmosphere;

the forming sliding block and the sliding block baffle are detachably connected with the first half die or the second half die via loaded bolts, respectively;

limiting side plates are respectively installed on two sides of the forming sliding block and the sliding block baffle, and detachably connected with the first half die or the second half die via side plate bolts; and axes of the loaded bolts are perpendicular to axes of the side plate bolts.

2. The processing die according to claim 1, wherein the inlet channel is vertically provided, a top of the inlet channel is an entrance to the billet, a bottom of the inlet channel connects with the expansion corner channel, a cross section of the inlet channel is circular, and a length of the inlet channel is the same as a displacement of the punch in a forming process of the fastener.

3. The processing die according to claim 2, wherein:

the expansion corner channel comprises a vertical channel and a horizontal channel, a top of the vertical channel connects with the bottom of the inlet channel, a bottom of the vertical channel connects with one side of the horizontal channel through an equal-channel intersection of 90°, and another side of the horizontal channel connects with the torsion channel;

a cross section of the vertical channel is circular, a cross-sectional dimension of the vertical channel is gradually increased from the top to the bottom of the vertical channel, a cross-sectional dimension of the top of the vertical channel is the same as that of the inlet channel, and a cross-sectional dimension of the bottom of the vertical channel is the same as that of the horizontal channel.

4. The processing die according to claim 3, wherein one side of the torsion channel connects with the other side of the horizontal channel, another side of the torsion channel connects with one side of the extrusion channel, and a cross section of the one side of the torsion channel and a cross section of the other side of the torsion channel are circular, a cross-sectional dimension of the one side of the torsion channel is the same as that of the other side of the horizontal channel, a cross-sectional dimension of the other side of the torsion channel is the same as that of the one side of the extrusion channel, a shape of cross section of the torsion channel is successively changed from a circle to an initial ellipse, gradually changed from the initial ellipse to a final ellipse and changed from the final ellipse to a circle from the one side of the torsion channel to the other side of the torsion channel continuously, and a long axis of the initial ellipse is perpendicular to a long axis of the final ellipse.

5. The processing die according to claim 4, wherein the extrusion channel comprises a head channel and a threaded screw channel, one side of the head channel connects with the other side of the torsion channel, a cross-sectional dimension of the one side of the head channel is same as that of the other side of the torsion channel, another side of the head channel connects with the threaded screw channel, a cross section of the head channel is circular, and a cross-sectional dimension of the head channel gradually decreases from the one side of the head channel to the other side of the head channel.

6. The processing die according to claim 1, wherein a sum of volumes of the inlet channel, the expansion corner channel, and the torsion channel is the same as a volume of the billet to be processed, and a volume of the extrusion channel is the same as that of the billet to be processed.

7. The processing die according to claim 1, wherein an upper die plate is installed at the top of the punch and configured for being connected with an upper sliding block of the hydraulic press, and a lower die plate is installed at the bottom of the die and configured for being connected with a workbench of the hydraulic press;

the first half die and the second half die are detachably connected via dowel pins and fixed bolts.

8. The processing die according to claim 1, wherein multiple heating rod holes are set in the die, the heating rod holes are configured for placing heating rods, and the heating rod holes are located on outer sides of the inlet channel, the expansion corner channel, the torsion channel and the extrusion channel, respectively.

9. A method for processing a fastener by using a processing die, wherein the processing die comprises a punch and a die which are assembled, a top of the punch and a bottom of the die are configured for being installed on a hydraulic press, the die comprises a first half die and a second half die which are clamped to form an inlet channel, an expansion corner channel and a torsion channel, a forming sliding block is included in the die, an extrusion channel is included in the forming sliding block, a shape of the extrusion channel is configured to match with that of the fastener, the inlet channel, the expansion corner channel, the torsion channel and the extrusion channel are sequentially assembled to form a die channel cavity, and a billet to be processed is successively subjected to upsetting in the inlet channel, shearing in the expansion corner channel, torsion in the torsion channel and extrusion in the extrusion channel under a pressure of the punch, and wherein the first half die and the second half die contain a sliding block hole respectively, the sliding block hole is wedge-shaped, the forming sliding block and a sliding block baffle are installed into the sliding block hole, and the sliding block baffle is assembled to the forming sliding block;

an air leakage hole is formed in the sliding block hole and communicates with atmosphere;

the forming sliding block and the sliding block baffle are detachably connected with the first half die or the second half die via loaded bolts, respectively; limiting side plates are respectively installed on two sides of the forming sliding block and the sliding block baffle, and detachably connected with the first half die or the second half die via side plate bolts; and axes of the loaded bolts are perpendicular to axes of the side plate bolts;

the method comprising following steps:

manufacturing the processing die of a fastener to be processed according to a geometry of the die channel cavity;

assembling the processing die, installing the die on a workbench of the hydraulic press, and installing the punch on an upper sliding block of the hydraulic press;

preheating the processing die, and heating the billet to be processed and performing heat preservation treatment;

placing the billet to be processed into the inlet channel, starting the hydraulic press, moving the punch downwards to a predetermined height, and returning the hydraulic press;

removing the forming sliding block from the die;

removing the processed fastener from the forming sliding block;

replacing a new forming sliding block;

repeating a process from placing the billet to replacing the forming sliding block.

10. The method according to claim 9, wherein the inlet channel is vertically provided, a top of the inlet channel is an entrance to the billet, a bottom of the inlet channel connects with the expansion corner channel, a cross section of the inlet channel is circular, and a length of the inlet channel is the same as the displacement of the punch in the forming process of the fastener.

11. The method according to claim 10, wherein the expansion corner channel comprises a vertical channel and a horizontal channel, a top of the vertical channel connects with the bottom of the inlet channel, a bottom of the vertical channel connects with one side of the horizontal channel through an equal-channel intersection of 90° and another side of the horizontal channel connects with the torsion channel; a cross section of the vertical channel is circular, a cross-sectional dimension of the vertical channel is gradually increased from the top to the bottom of the vertical channel, a cross-sectional dimension of the top of the vertical channel is the same as that of the inlet channel, and a cross-sectional dimension of the bottom of the vertical channel is the same as that of the horizontal channel.

12. The method according to claim 11, wherein one side of the torsion channel connects with the other side of the horizontal channel, an other side of the torsion channel connects with one side of the extrusion forming channel, and a cross section of the one side of the torsion channel and a cross section of the other side of the torsion channel are circular, a cross-sectional dimension of the one side of the torsion channel is the same as that of the other side of the horizontal channel, a cross-sectional dimension of the other side of the torsion channel is the same as that of the one side of the extrusion channel, a shape of cross section of the torsion channel is successively changed from a circle to an initial ellipse, gradually changed from the initial ellipse to a final ellipse and changed from the final ellipse to a circle from the one side of the torsion channel to the other side of the torsion channel continuously, and a long axis of the initial ellipse is perpendicular to a long axis of the final ellipse.

13. The method according to claim 12, wherein the extrusion channel comprises a head channel and a threaded screw channel, one side of the head channel connects with the other side of the torsion channel, a cross-sectional dimension of the one side of the head channel is same as that of the other side of the torsion channel, another side of the head channel connects with the threaded screw channel, a cross section of the head channel is circular, and a cross-sectional dimension of the head channel is gradually decreased from the one side of the head channel to the other side of the head channel.

14. The method according to claim 9, wherein a sum of volumes of the inlet channel, the expansion corner channel, and the torsion channel is the same as a volume of the billet to be processed, and a volume of the extrusion channel is the same as that of the billet to be processed.

15. The method according to claim 9, wherein an upper die plate is installed at the top of the punch and configured for being connected with an upper sliding block of the hydraulic press, and a lower die plate is installed at the bottom of the die and configured for being connected with a workbench of the hydraulic press;

the first half die and the second half die are detachably connected via dowel pins and fixed bolts.

16. The method according to claim 9, wherein multiple heating rod holes are set in the die, the heating rod holes are configured for placing heating rods, and the heating rod holes are located on outer sides of the inlet channel, the expansion corner channel, the torsion channel and the extrusion channel, respectively.

* * * * *